US005328427A

United States Patent [19]

Sleamaker

[11] Patent Number: 5,328,427

[45] Date of Patent: Jul. 12, 1994

[54] SKATING/SKIING SIMULATOR WITH ERGOMETRIC INPUT-RESPONSIVE RESISTANCE

[76] Inventor: Robert H. Sleamaker, P.O. Box 1064, Williston, Vt. 05495

[21] Appl. No.: 151,861

[22] Filed: Nov. 15, 1993

[51] Int. Cl.[5] ..... A63B 69/18; A63B 22/00

[52] U.S. Cl. ..... 482/71; 482/51; 482/110

[58] Field of Search ..... 482/51, 70, 71, 52, 482/53, 54, 56, 148, 110

[56] References Cited

U.S. PATENT DOCUMENTS

| | | | |
|---|---|---|---|
| 3,791,645 | 2/1974 | Stelma | 482/71 |
| 4,340,214 | 7/1982 | Schutzer | 482/72 |
| 4,650,184 | 3/1987 | Brebner | 482/71 |
| 5,029,848 | 7/1991 | Sleamaker | 482/96 |
| 5,078,389 | 1/1992 | Chen | 482/71 |

FOREIGN PATENT DOCUMENTS

| | | | |
|---|---|---|---|
| 3707065 | 9/1988 | Fed. Rep. of Germany | 482/70 |

*Primary Examiner*—Stephen R. Crow
*Attorney, Agent, or Firm*—Donald W. Meeker

[57] ABSTRACT

Foot pads with foot straps are mounted to roller carriages which roll along a horizontal monorail with stationary middle supports and telescoping end supports. A rotatable shaft attached to one of the end supports is attached to an ergometric input-responsive variable resistance. Each of two cables wound around a spring-loaded retractable one-way clutch driver on the rotatable shaft connects to each of the foot pads. Stepper pedals hinged to the end support opposite the rotating shaft are each attached by a cable wound around the rotatable shaft. A long front rail with sliding hand grips and a short side rail are detachably mounted. A nordic double poling attachment may be mounted midway on the front rail with cables wound over pulleys and around the rotatable shaft. The platform is hinged in the center to fold in half for storage and transportation. A stationary foot pad is positioned adjacent to the hinges, and also serves as a stop for the moving foot pads. End foot pad stops may be positioned at any of a number of locations along the monorail. An electronic microprocesser performance monitor senses, interprets, and displays information about the output of the user on the invention. Any of a number of ergometric input-responsive resistance means can be used on the rotatable shaft including: a flywheel with a band brake, a vaned flywheel inside a variable opening case, a wind load, a water load, an eddy current load, a flywheel with a centrifugal braking device, and an electric motor and flywheel load.

20 Claims, 2 Drawing Sheets

SKATING/SKIING SIMULATOR WITH ERGOMETRIC INPUT-RESPONSIVE RESISTANCE

BACKGROUND OF THE INVENTION

1. Technical Field

The present invention relates to exercise machines, and in particular to a skating/skiing exercise machine with side-to-side foot pads rolling on a monorail with the pads pulling cables which are connected to ergometric variable input-responsive resistance.

2. Description of the Prior Art

Skating and skiing require practice and training for best performance, especially when engaged in competition. Actually performing the sports activities when possible (overcoming obstacles such as adverse weather and inadequate access to facilities) provides focused exercise but doesn't offer an adequate opportunity to vary the resistance involved in carrying out the activity to produce increased strength.

There are many exercise devices available on the market for providing cardiovascular and muscular development, but most of them fail to produce a true simulation of the actual sports activity for which the exerciser is training. Part of the difficulty lies in trying to shape exercise equipment to allow the full range of body movement in the same form as in the sport. Another difficulty lies in trying to create resistance in the exercise equipment which simulates actual resistance encountered in a sports activity while in motion in the sport having overcome inertial resistance.

Exercise equipment is often boring and uninvolving when the exerciser repeats the same action over and over again while remaining in a stationary position on the equipment. In most equipment, the exerciser does not experience the motion experienced in the actual sports activity.

Most prior art exercise devices for skating and skiing do not provide for side-to-side motion simulating the actual motion. Two U.S. Pat. Nos. (3,791,645 and 4,340,214) which do provide for side-to-side motion and two U.S. Pat. Nos. (4,781,372 and 4,915,373) which provide angled side/back motion do not provide ergometric variable resistance. U.S. Pat. No. 3,791,645 has a motor driving a belt which engages foot cradles to move the foot cradles to the side. U.S. Pat. No. 4,340,214 provides side sloping tracks. U.S. Pat. No. 4,781,372 uses variable weights lifted by cords connected to the foot cradles. U.S. Pat. No. 4,915,373 utilizes foot pedals in sliding tracks which have variable friction brake linings in the tracks. None provide the simulation of actual skating and skiing side-to-side motion when there is a gliding effect produced by inertia in motion after the initial inertia at rest is overcome.

Prior art exercise devices for skating and skiing generally do not provide for other exercise options.

DISCLOSURE OF INVENTION

The pull cables attached to the side-to-side rolling foot pads wind over pulleys and around spring-loaded retractable one-way clutch drivers secured around a rotatable shaft with alternative types of flywheels utilizing variable input-responsive resistance means forming an ergometric system with variable input-responsive resistance determined by the way the exerciser uses the device and measurable by electronic means. Any of a number of ergometric variable input-responsive resistance systems may be coupled with the rolling foot pads on a horizontal monorail. Using a flywheel with an ergometric variable input-responsive resistance simulates actual resistance conditions, wherein after overcoming the initial resistance of inertia with the body at rest there is a sense of increased flow with increased speed aided by inertia with the body in motion. Hard fast motions increase resistance as in actual conditions. This simulation of actual inertial conditions with the motion of the body back and forth along the monorail allows the user to experience the sensation of actually performing the sports activity with the added advantage of being able to develop added strength and cardiovascular stamina more than is possible in the actual activity by increasing the resistance by adjusting the ergometric input-responsive resistance or by merely increasing the speed and intensity of the user's movement. At the same time the activity can be monitored and measured with instant feedback by electronic monitoring and measuring means.

In addition to increased strength and endurance the training value of the invention is further enhanced because it is much easier to observe the actual movements made by the exerciser on the invention than in actual conditions of performing the sports activity. Any errors in form may be observed and corrected by the exerciser observing his or her own activity in a mirror or on video or by a coach observing the exerciser.

Hand pull cables connected to the same ergometric variable input-responsive resistance system may be provided with ski pole handles for cross country ski-skating training, thereby simulating actual conditions.

Other applications are also possible including a stair stepper added to the end of the frame working off of the same cable system by attaching the cables to the foot pedals which are hinged to the support.

Inclining the foot pads to be higher at the outer edges simulates the condition of tilting the foot during this skating motion in all the sports. The tilt along with a raised ridge at the outer edges of the pads prevents the feet from slipping off the pads. Additional foot straps over the feet help in securing the feet in the outward pushing action and enable the feet to draw the foot pads back toward the center of the monorail.

Providing hinges in the longitudinal mid portion enables folding the device for easier transport or storage. The invention may also be folded into a right angled configuration for use of a stepper to simulate a climbing motion combined with hand pull cables to simulate a poling motion. Telescoping leg supports at each end of the monorail enable the monorail to be elevated at each end to further increase the resistance.

Sliding hand grips on the front hand rail enable the user to slide back and forth comfortably along the monorail with a natural positioning of the body moving with the strides of the legs obviating the need to be stretching to reach stationary hand grips.

Rubber stop pads can be positioned adjustably at various distances from the center to allow strides of various breadth.

BRIEF DESCRIPTION OF THE DRAWINGS

These and other details and advantages of my invention will be described in connection with the accompanying drawings, which are furnished only by way of illustration and not in limitation of the invention, and in which drawings.

BEST MODE FOR CARRYING OUT THE INVENTION

Figure 1:
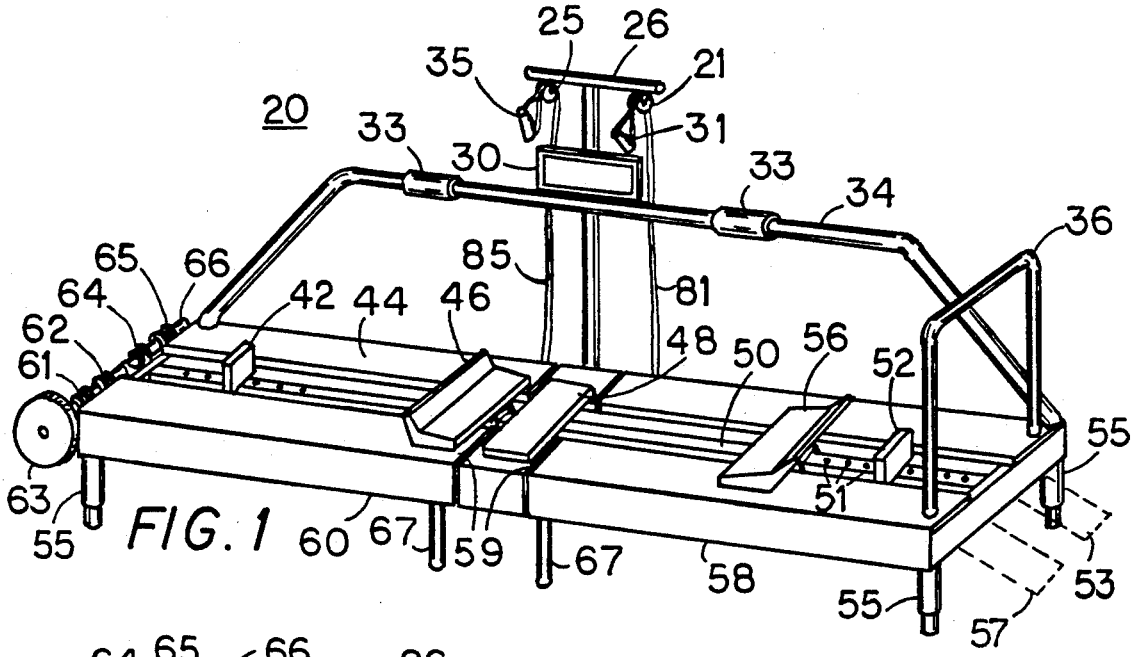
FIG. 1 is a perspective view of the preferred embodiment of the invention with side-to-side foot pads, a side rail, end rail, cross country ski poling attachment, stepper platforms, monitor, and a single rotatable shaft ergometric variable resistance system with spring-loaded retractable one-way clutch drivers for the cables and a single variable resistance flywheel element.
Figure 2:
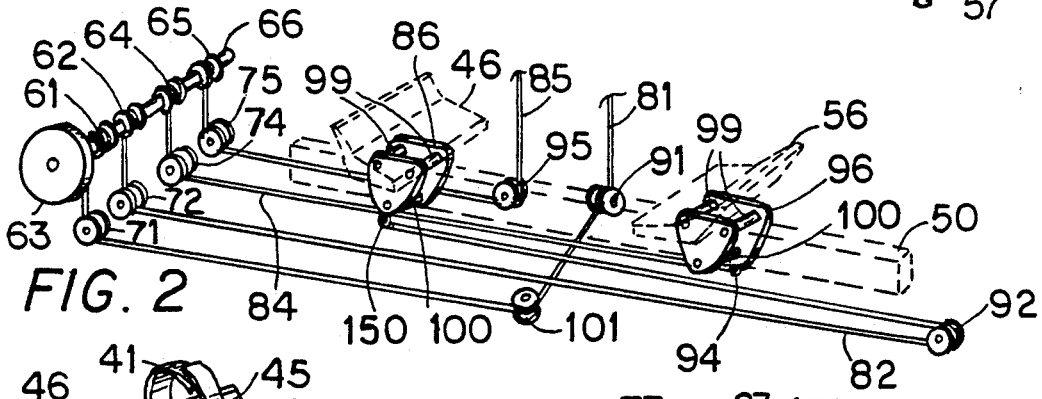
FIG. 2 is a partial perspective view of the preferred embodiment of the invention showing the cable and pulley systems.

In FIGS. 1 and 2 a skating/skiing simulator exercise machine 20 with ergometric variable input-responsive resistance 63 comprises a monorail 50 mounted horizontally and supported on two pair of central legs 67 and a pair of telescoping legs 55 at each end as adjustable supports. The telescoping legs 55 at each end may be raised to create upwardly sloping sides on the monorail. A pair of foot pads 46 and 56, each attach atop a roller carriage 86 and 96 respectively.

Figure 3:
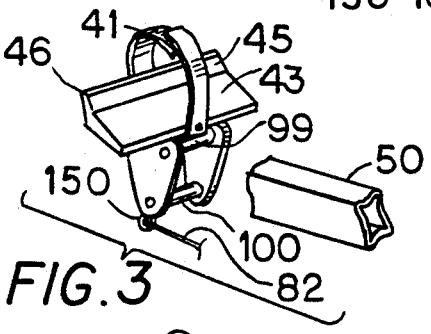
FIG. 3 is a partial perspective exploded view of one foot pad with the roller base with top and bottom rollers which roller base fits over the monorail.

In FIG. 3 the foot pad 46 is inclined upwardly toward an outer edge on the foot surface 43 and the outer edge has an elevated ridge 45 protruding upwardly to prevent the foot from slipping off as the user pushes the foot pad outwardly. A foot strap 41 adjustably secured by Velcro (TM) or other adjustable means over the foot of the user further secures the user's foot to the foot pad and allows rapid and easy return of the foot pad to the center position. The roller carriages 86 and 96 comprise two side plates connected by paired rollers 99 between tops of the plates and a single roller 100 between bottoms of the plates, which roller carriage rolls along the monorail 50 with the rollers contacting top and bottom surfaces of the monorail.

Figure 6:
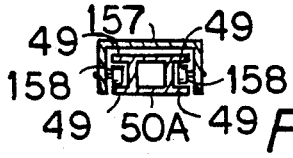
FIG. 6 is a cross-sectional exploded view of an alternative inverted U-shaped roller base with side wheels which fits over an alternative of the monorail with extending flanges.

In FIG. 6 an alternate embodiment of the monorail 50A comprises side flanges 49 extending from a top and bottom surface of the monorail along the entire length of the monorail. An alternate embodiment of the roller carriage comprises an inverted U-shaped housing 157 having a top plate and two side plates extending downwardly from the top plate, wherein side wheels 158 are rotatably attached to the side plates inside the side plates. The roller carriage rolls along the monorail with the wheels rotatably contacting the flanges of the monorail.

A rotatable shaft 66 is attached to one of the end supports perpendicular to the monorail. An ergometric input-responsive variable resistance means 63 is attached to the rotatable shaft 66.

A first cable 82 wound around the rotatable shaft 66 on a spring-loaded retractable one-way clutch driver 62 passes under a pulley 72 below the shaft and extends the length of the invention and over a pulley 92 at the opposite end support and back to an attaching point 150 on the roller carriage 86 of the foot pad 46 adjacent to the rotatable shaft 66. The foot pad 46 is under tension from the input- responsive variable resistance 63 as it is pushed by a skating motion away from the center of the invention toward the end supporting the rotatable shaft 66. A second cable 84 wound around another spring-loaded retractable one-way clutch driver 64 on the rotatable shaft 66, passes under a pulley 74 below the shaft and extends to the an attaching point 94 on the roller carriage 96 of the other foot pad 56. The second foot pad 56 is under tension from the input-responsive variable resistance 63 as it is pushed by a skating motion away from the center and away from the rotatable shaft. Rubber foot pad stops 42 and 52 are positioned on top of the monorail 50 along the monorail in any of a number of adjustment locations with openings 51 on the top of the monorail 50 to receive a securing element from the stops.

A horizontal platform 44 is supported by the leg supports positioned above the monorail, with a slot along the longitudinal center of the platform to admit contact of the foot pads, positioned above the platform, with the monorail, positioned below the platform. A pair of hinges 59 are positioned transversely across a center of the monorail allowing the monorail to fold in the center. A stationary foot pad 48 is positioned in the center of the invention on the platform adjacent to the hinges 59 and also acts as a center stop for the moving foot pads 46 and 56. The stationary foot pad 48 allows the user to place one foot on the stationary foot pad 48 and use only one moving foot pad 46 or 56 at a time.

A detachable handrail 34 with sliding hand grips 33 extends along the long front side of the invention as a means of support and balance while using the foot pads 46 and 56 in a skating motion characteristic of ice skating, inline skating, roller skating, and cross country ski-skating. The sliding hand grips 33 enable the user to move comfortably along the monorail simulating natural strides without having to stretch as would be necessary to reach stationary hand grips.

A T-shaped bracket 26 is mounted in the center of the detachable front handrail 34, wherein two pulleys 25 and 21 attached to the T-shaped bracket 26 each receive a cable 85 and 81 with ski pole handle grips 35 and 31 mounted on the ends of the cables to enable a user to pull on the cables while pushing outwardly on the foot pads 46 and 56 to simulate cross country ski-skating. In FIG. 2, cable 85 passes from pulley 25 under pulley 95 and pulley 75 to the spring-loaded retractable one-way clutch driver 65 on the rotatable shaft 66. Cable 81 passes from pulley 21 under pulley 91 and around pulley 101, and under pulley 71 to the spring-loaded retractable one-way clutch driver 61 on the rotatable shaft 66.

A performance monitor 30 mounted on the detachable front handrail 34 indicates user work output information sensed, interpreted, and displayed by an electronic microprocessor. Standard electronic means are used for monitoring, interpreting, and displaying the performance level of a user with a means for measuring number of rotations and speed of rotation of the rotatable shaft, an electronic means for interpreting user input based on the configuration of the invention and depending on which sport is being simulated, and an electronic monitor means for displaying information about user physical output.

Figure 4:
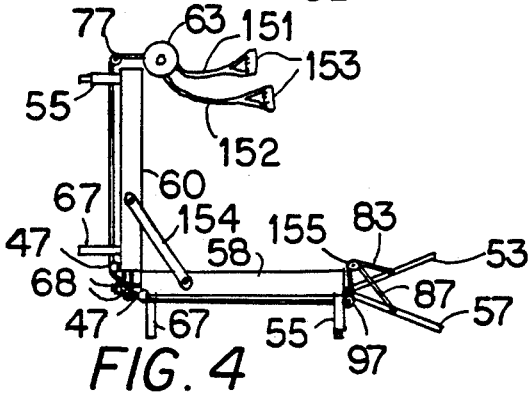
FIG. 4 is a side elevational simplified view showing an alternate embodiment of the invention bent at a right angle for using pull cables with the stepper platforms, shown with their cable systems.

In FIGS. 1 and 4, a pair of stepper foot pedals 57 and 53 are hinged to the end support opposite to the rotatable shaft, wherein a cable 87 and 83 runs from each hinged foot pedal to the rotatable shaft 66 over a series of pulleys. For example cable 87 runs over pulley 155 and under pulley 97, around pulleys 47 and over pulley 77 to a spring-loaded retractable one-way clutch driver (not shown in FIG. 4) on the rotatable shaft. A side hand rail 36 is mounted on the end support above the stepper foot pedals 57 and 53 for use as a support and balance while using the stepper foot pedals. If the invention is positioned by hinging in the middle at a right angle held by a long rigid bar 154, as in FIG. 4, the user may combine a stepping simulation with ski poling by pulling ski pole handles 153 attached to cables 151 and 152 which attach to the rotatable shaft 66.

Figure 5:
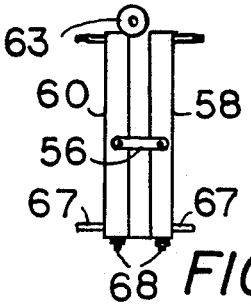
FIG. 5 is a side elevational simplified view showing the preferred embodiment of the invention folded in half for storage or transport.

In FIG. 5 the two halves 58 and 60 of the invention are folded over each other with double hinges 59A and secured together by a rigid bar 156 for transportation or storage. Casters 68 mounted at the edges of the platform adjacent to the center hinges provide a means for easily transporting the invention when it is folded in half.

Alternative types of variable input-responsive resistance means with flywheels form ergometric systems with variable input-responsive resistance determined by the way the exerciser uses the device and measurable by the electronic means. In all of the ergometric systems of the present invention the torque on the system is speed dependent, responsive to the input by the user. Increased pull by the exerciser on the pull cables increases the variable resistance, but retains the sense of flow of a body in motion with moving inertia. Hard fast motions increase resistance as in actual conditions.

In FIGS. 7–13 various alternative flywheel assemblies are shown which would replace the flywheel 63 on the rotatable shaft 66 (in FIGS. 1 and 2).

Figure 7:
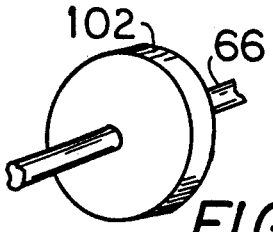
FIG. 7 is a partial perspective view of a centrifugal brake speed regulator used as the ergometric variable input-responsive resistance means on the rotatable shaft of FIG. 1.

In FIG. 7 the alternative flywheel assembly on the rotatable shaft 66 comprises a centrifugal brake. As the flywheel rotates faster, elements in the centrifugal brake pivot outwardly under centrifugal force to provide a braking or speed regulating function.

Figure 8:
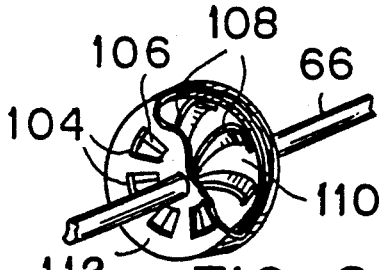
FIG. 8 is a partial perspective view of a vaned flywheel inside a casing with variable openings used as the ergometric variable input-responsive resistance means on the rotatable shaft of FIG. 1.

In FIG. 8 the ergometric variable input-responsive resistance means on the rotatable shaft 66 of FIG. 1 comprises a vaned flywheel 110 with curved vanes 108 inside an enclosed case 112 with spaced openings 104 on the vaned side of the flywheel, which spaced openings 104 are controlled by variable vents 106 which create more resistance by closing down the openings.

Figure 9:
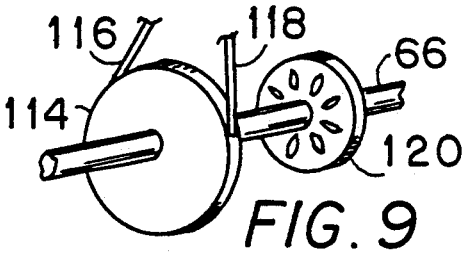
FIG. 9 is a partial perspective view of a flywheel with a band (capstan) brake and separate wind resistance fan wheel used as the ergometric variable input-responsive resistance means on the rotatable shaft of FIG. 1.

In FIG. 9 a flywheel with a band brake 114 is coupled with a small fan blade 120 both on the rotatable shaft 66 to create a "wind load" with the brake for additional variable input-responsive resistance in the system. Band 116 is attached to a rigid point on the frame and band 118 may be tightened or loosened to vary the resistance adjustably.

Figure 10:
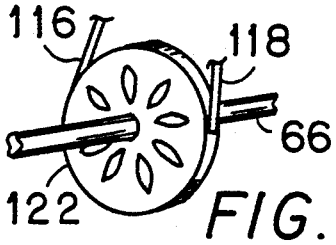
FIG. 10 is a partial perspective view of a single flywheel with a band (capstan) brake and a built in wind resistance fan used as the ergometric variable input-responsive resistance means on the rotatable shaft of FIG. 1.

In FIG. 10 the fan blades are incorporated in the band brake flywheel and fan to create a wind load band brake flywheel 122. Increased force on the pull cables by the exerciser increases the variable input-responsive resistance created by the "wind load" coupled with the brake resistance.

Figure 11:
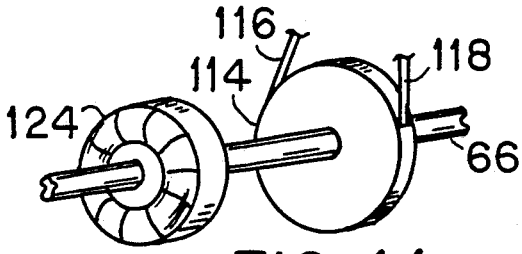
FIG. 11 is a partial perspective view of a flywheel with a band (capstan) brake and a separate water load having an impeller rotating in a water-filled container used as the ergometric variable input-responsive resistance means on the rotatable shaft of FIG. 1.

In FIG. 11 a band brake flywheel 114 is coupled with a "fluid load" 124 both attached to the rotatable shaft 66. The fluid load 124 comprises a rotating impeller inside a container or housing filled with fluid. Increased force on the pull cables by the exerciser increases the variable resistance created by the "fluid load" coupled with the brake resistance.

Figure 12:
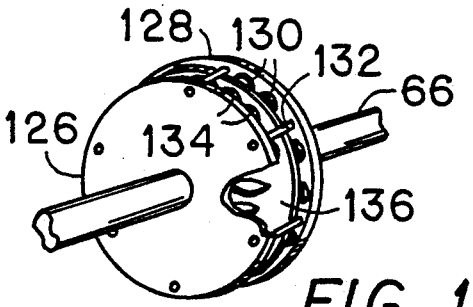
FIG. 12 is a partial perspective view of a magnetic (eddy current) three wheeled interconnected system used as the ergometric variable input-responsive resistance means on the rotatable shaft of FIG. 1.

In FIG. 12 a magnetic (eddy current) load unit is used to create the variable input-responsive resistance on the rotatable shaft 66. A stationary disk 126 with spaced magnets around the circumference is connected by standoff pins 132 to an adjustably turnable stationary disk 128 with spaced magnets around the circumference. A rotating conductive disk 136, with wind vanes for cooling, is positioned rotatably between the other disks fixedly attached to the rotatable shaft 66. As the conductive disk 136 turns in response to the rotatable shaft, the conductive disk cuts the magnetic flux lines to create a torque resistance proportional to the number of flux lines, the speed, the radius, and inversely proportional to the resistance of the conductive disk.

Figure 13:
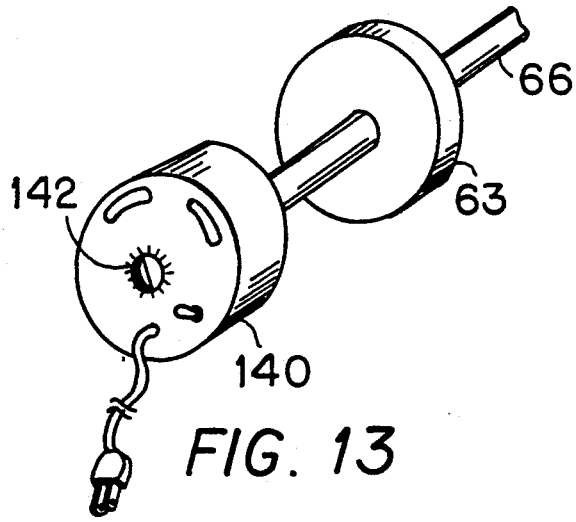
FIG. 13 is a partial perspective view of an electric motor and a flywheel used as the ergometric variable input-responsive resistance means on the rotatable shaft of FIG. 1.

In FIG. 13 a variable speed electric motor 140 with variable speed control knob 142 is used to create the variable input-responsive resistance on the rotatable shaft 66 along with the flywheel 63. The motor turns the rotating shaft to create the sensation of inertia in motion. When the exerciser attempts to pull on the pull cables to rotate the shaft at a speed faster than the motor, the motor and flywheel create a resistance simulating the natural resistance of a skater or skier for building strength and endurance.

In all of these systems the motion of the body of the exerciser on the foot pads which move along the monorail simulates actual motion of the body in the sport. The variable input-responsive resistance created by pulling on the cables simulates the actual resistance experienced by the exerciser in the actual sports activity. Initial resistance is high momentarily due to inertia. Then inertia in motion simulates lowered resistance as in gliding over ice or snow or on wheels. But increased pull on the cables by the exerciser also increases the resistance in the system simulating the resistance the exerciser would actually experience in the sports activity by trying to push harder in a skating motion or trying to pull harder with a ski poling motion.

Structural components of the invention are made of high strength but relatively light weight steel or aluminum. Cables are preferably fabricated of wire cable, possibly coated, for resistance to abrasion.

It is understood that the preceding description is given merely by way of illustration and not in limitation of the invention and that various modifications may be made thereto without departing from the spirit of the invention as claimed.

I claim:

1. A skating/skiing simulator with ergometric variable input-responsive resistance comprising:

a monorail mounted horizontally and supported in a middle portion by middle supports and at each of two ends of the monorail by telescoping end supports;

a pair of foot pads each attached atop a roller carriage with rollers rolling along the monorail;

a rotatable shaft attached to one of the end supports perpendicular to the monorail, wherein an ergometric input-responsive variable resistance means is attached to the rotatable shaft;

a first cable wound around the rotatable shaft extends from the rotatable shaft over a pulley at the opposite end support and back to the foot pad adjacent to the rotatable shaft;

a second cable wound around the rotatable shaft extends from the rotatable shaft to the other foot pad;

wherein both cables are wound around spring-loaded retractable one-way clutch drivers around the rotating shaft so that the cables rewind after being pulled;

a detachable front hand rail with sliding hand grips mounted along a front side of the monorail;

a performance monitor mounted on the front hand rail which performance monitor indicates user work output information sensed, interpreted, and displayed by an electronic microprocessor.

2. The invention of claim 1 wherein each foot pad is inclined upwardly toward an outer edge and the outer edge has an elevated ridge protruding upwardly and a top foot strap.

3. The invention of claim 2 further comprising an electronic means for monitoring, interpreting, and displaying a work output level of a user with a means for measuring number of rotations and speed of rotation of the rotatable shaft and work output, an electronic means for interpreting user input based on the configuration of the invention and depending on which sport is being simulated, and an electronic monitor means for displaying information about user physical output.

4. The invention of claim 3 further comprising rubber foot pad stops positioned on top of the monorail in any of a number of locations.

5. The invention of claim 4 further comprising a horizontal platform supported by the middle and end supports positioned above the monorail, and further comprising a slot along the longitudinal center of the platform to admit contact of the foot pads, positioned above the platform, with the monorail, positioned below the platform.

6. The invention of claim 5 further comprising a T-shaped bracket mounted in the center of the front hand rail, wherein two pulleys attached to the T-shaped bracket and each of the two pulleys receive a cable connected over other pulleys to the rotatable shaft, and wherein ski pole handle grips are mounted on the ends of the cables.

7. The invention of claim 6 further comprising at least one hinge transversely across a center of the platform allowing the platform to fold in the center.

8. The invention of claim 7 further comprising a stationary foot pad positioned in the center of the platform adjacent to the hinges, which stationary foot pad also acts as a center stop for the moving foot pads.

9. The invention of claim 7 further comprising castors mounted adjacent to the hinge adjacent to the center of the platform, wherein the invention may be rolled on the casters when the platform is folded in half at the hinges.

10. The invention of claim 7 further comprising a pair of stepper pedals hinged to the end support opposite to the rotatable shaft, wherein a cable runs from each hinged stepper pedal to the rotatable shaft.

11. The invention of claim 10 further comprising a side hand rail mounted on the end support above the stepper pedals.

12. The invention of claim 10 wherein the rotatable shaft end of the monorail is pivoted up at a right angle to the other half of the monorail and pull cables from the rotatable shaft are fitted with ski pole grip handles and used simultaneously with the stepper pedals.

13. The invention of claim 3 wherein the roller carriage comprises two side plates connected by paired rollers between tops of the plates and a single roller between bottoms of the plates, which roller carriage rolls along the monorail with the rollers contacting top and bottom surfaces of the monorail with the roller carriage encircling the monorail.

14. The invention of claim 3 wherein the monorail comprises side flanges extending from a top and bottom surface of the monorail along the entire length of the monorail and the roller carriage comprises an inverted U-shaped housing having a top plate and two side plates extending downwardly from the top plate, wherein side wheels are rotatably attached to the side plates inside the side plates, which roller carriage rolls along the monorail with the wheels contacting the flanges of the monorail.

15. The invention of claim 3 wherein the ergometric variable input-responsive resistance assembly comprises a flywheel with a band brake secured to the rotatable shaft and a disk with fan blades is also secured to the rotatable shaft.

16. The invention of claim 3 wherein the ergometric variable input-responsive resistance assembly comprises a vaned flywheel with curved vanes on a side of the flywheel, which vaned flywheel is inside an enclosed case, which case has spaced openings on the case adjacent the vaned side of the flywheel, which spaced openings are controlled by variable vents which create more resistance by closing down the openings, wherein the vaned flywheel is secured to the rotatable shaft.

17. The invention of claim 3 wherein the ergometric variable input-responsive resistance assembly comprises a flywheel with a band brake secured to the rotatable shaft and a wheel having impeller blades spinning in a water-filled container secured to the rotatable shaft.

18. The invention of claim 3 wherein the ergometric variable input-responsive resistance assembly comprises a pair of spaced apart stationary disks with magnets positioned around a perimeter of each disk and a rotating conductive disk inbetween the stationary disks with the rotating conductive disk attached to the rotatable shaft.

19. The invention of claim 3 wherein the ergometric variable input-responsive resistance assembly comprises a flywheel with a centrifugal braking device secured to the rotatable shaft.

20. The invention of claim 3 wherein the ergometric variable input-responsive resistance assembly comprises a variable speed electric motor with a variable speed control knob, wherein the electric motor is secured to the rotatable shaft and a flywheel is attached to the rotatable shaft.

* * * * *